United States Patent [19]

Rath

[11] Patent Number: 4,795,046

[45] Date of Patent: Jan. 3, 1989

[54] DUST CHUTE AND COMBINATION DUST CHUTE AND WASTEBASKET DEVICE

[76] Inventor: Gary Rath, 1226 Santa Barbara St., Santa Barbara, Calif. 93101

[21] Appl. No.: 9,460

[22] Filed: Feb. 2, 1987

[51] Int. Cl.[4] ..... B65D 67/12

[52] U.S. Cl. ..... 220/1 T; 15/257.1

[58] Field of Search ..... 220/1 T, 1 R, 85 R; 15/257.1

[56] References Cited

U.S. PATENT DOCUMENTS

| | | | |
|---|---|---|---|
| 3,156,941 | 11/1964 | Tomaiuolo | 220/1 T |
| 3,390,804 | 7/1968 | Morgan | 220/1 T |
| 4,312,531 | 1/1982 | Cross | 15/257.1 |
| 4,503,661 | 3/1985 | Potter | 15/257.1 |

FOREIGN PATENT DOCUMENTS

| | | | |
|---|---|---|---|
| 682465 | 3/1964 | Canada | 220/1 T |
| 2166040 | 4/1986 | United Kingdom | 220/1 T |

*Primary Examiner*—Willis Little

*Attorney, Agent, or Firm*—John J. Posta, Jr.

[57] ABSTRACT

The device includes a dust chute releasably connected by flexible resilient fingers to the upper end of an upstanding open topped wastebasket, and vertically depending down the outside thereof. The chute includes upper and lower vertically telescoping walls, the upper wall bearing the fingers and the lower wall bearing a downwardly and outwardly sloped inclined ramp. The telescoping walls and ramp bear side rims or wings angled outwardly to prevent loss of dust and debris from the chute. The vertically telescoping walls may also telescope laterally in order to adjustably space the rims to just clear the sides of a sweeping broom. The inclined ramp can be hinged to the lower telescoping wall to control the slope of the ramp. A splash guard can be hinged to the upper end of the upper telescoping wall by spaced legs connected to an open bottomed cover for movement between a position overlying and a position away from the upper end of the wastebasket. The device is simple, inexpensive and adaptable to curve walled and flat walled wastebaskets of various heights.

12 Claims, 2 Drawing Sheets

FIG. 1
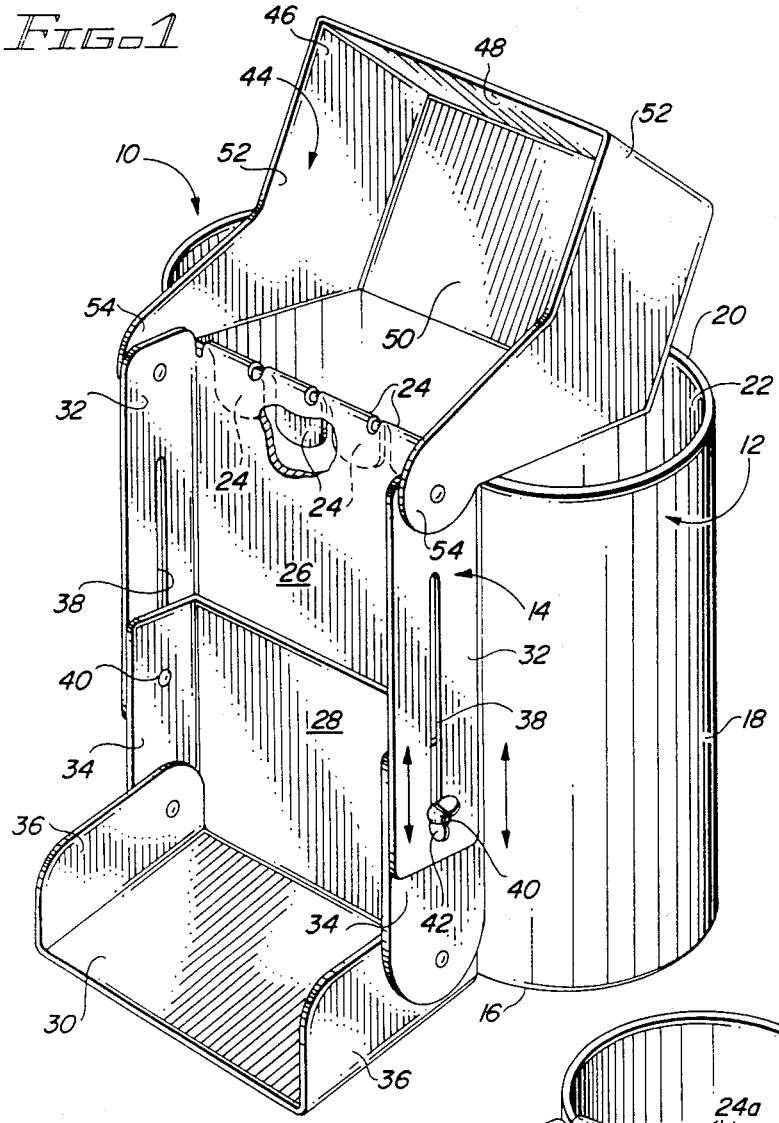
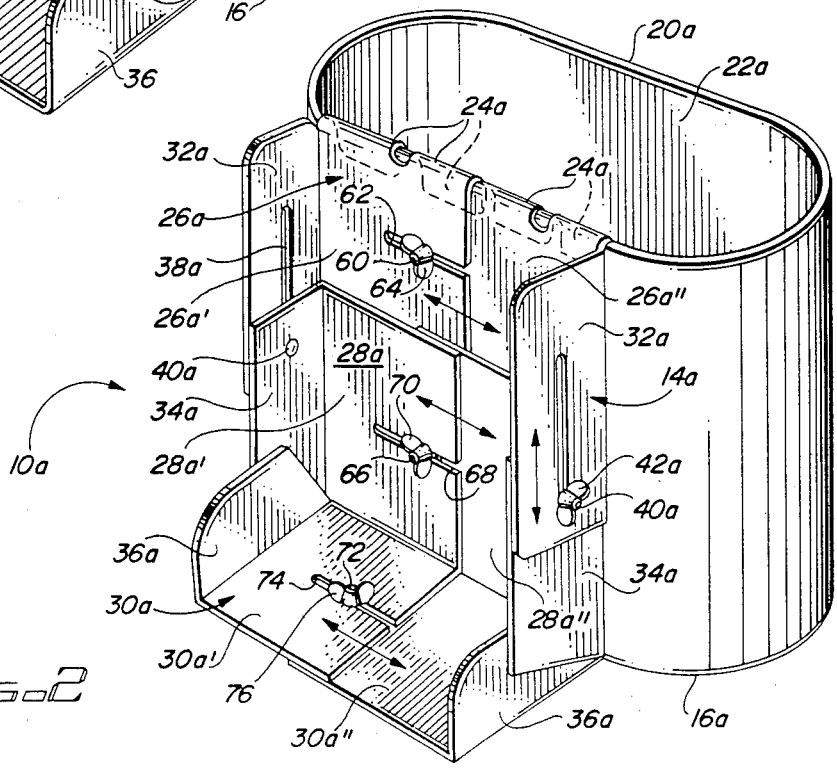
FIG. 2

DUST CHUTE AND COMBINATION DUST CHUTE AND WASTEBASKET DEVICE

BACKGROUND OF THE INVENTION

1. Field of the Invention

The present invention generally relates to cleaning and storage devices and, more particularly, to an improved dust chute for wastebaskets and to a wastebasket bearing such chute.

2. Prior art

Wastebaskets, trash cans, bins and the like are typically filled with dust and debris during a cleaning chore by first gathering such dust and debris, as by broom sweeping them into a pile, then bending over and sweeping the pile into a dust pan with the broom, then lifting the filled dust pan to the open top of the wastebasket or the like and tipping the dust pan over to allow the dust and debris to drop into the wastebasket or the like. Thus, a separate dust pan is required and considerable effort is needed to sweep dust and debris into it, then lift and tilt it to release the dust and debris therefrom. In many cases, the dust pan is either of small capacity or is difficult to lift and tilt without inadvertently dumping its contents outside the wastebasket.

Certain devices have been devised in the past to overcome some of the above-mentioned difficulties. See, for example, U.S. Pat. No. 4,550,440 which discloses adjustable rims for flexible dust bags, and contraptions for sweeping dust and debris into the bags when they are laid on a floor. A more complicated wheeled tilting dust container is disclosed in U.S. Pat. No. 4,442,567. A similar device is disclosed in U.S. Pat. No. 4,503,661. Several devices comprise specially constructed complicated dust bins bearing dust pans integrally connected thereto. See, for example, U.S. Pat. Nos. 2,791,374, 3,156,941, 769,436, 577,452, 3,390,804, 2,237,836 and 3,412,419. None of those devices employ conventional wastebaskets and the like. U.S. Pat. Nos. 2,601,069 and 3,861,730 are directed to specific types of dust pans.

There remains a need for a device which is simple, inexpensive and efficient in the handling of dust and debris. Such device should eliminate the need to lift a separate dust pan to the top of a wastebasket in order to pass dust and debris thereinto. Such device should preferably include a conventional wastebasket or bin of an conventional size and shape, rather than the complicated dust and debris storage bins set forth in the above-listed patents.

SUMMARY OF THE INVENTION

The improved dust chute of the present invention and the improved device of the present invention which combines the chute and a wastebasket satisfy the foregoing needs. The chute and device are substantially as set forth in the accompanying Abstract. Thus, the device comprises a conventional open-topped wastebasket, can or bins to which is releasably connected a novel dust and debris chute. The chute includes upper and lower flat vertically telescoping walls, disposed over the outside of the wastebasket, the upper wall bearing curved, flexible resilient fingers which overlap and releasably grip the top rim of the wastebasket, whether that rim is flat or curved. The lower telescoping wall bears at its lower end a downwardly sloping inclined ramp which may be hinged thereto in order to change its angle. The telescoping walls adapt the chute to wastebaskets of various heights so as to properly position the lower end of the inclined ramp at floor level.

The telescoping walls and ramp bear outwardly extending side rims to prevent loss of dust and debris from the chute. The vertically telescoping walls and ramp may also telescope laterally so a to be able to space the rims a distance which just accommodates the width of a broom, in order to increase the efficiency of the broom in sweeping dust and debris up the chute and into the wastebasket, without the use of a dust pan and without loss of dust and debris down between the sides of the broom and chute and an open bottomed splash guard or dust cover may be hinged to the upper end of the upper telescoping wall to pivot between a position overlying the top of the wastebasket and a position away therefrom, the latter position being used when the wastebasket is to be emptied.

Various other features of the invention are set forth in the following detailed description and accompanying drawings.

DRAWINGS

FIG. 1 is a schematic perspective view, partly broken away, of a first preferred embodiment of the improved combination dust chute and wastebasket device of the present invention;

FIG. 2 is a schematic perspective vie,, partly broken away, of a second preferred embodiment of the improved combination dust chute and wastebasket device of the present invention;

DETAILED DESCRIPTION

FIG. 1

Figure 3:
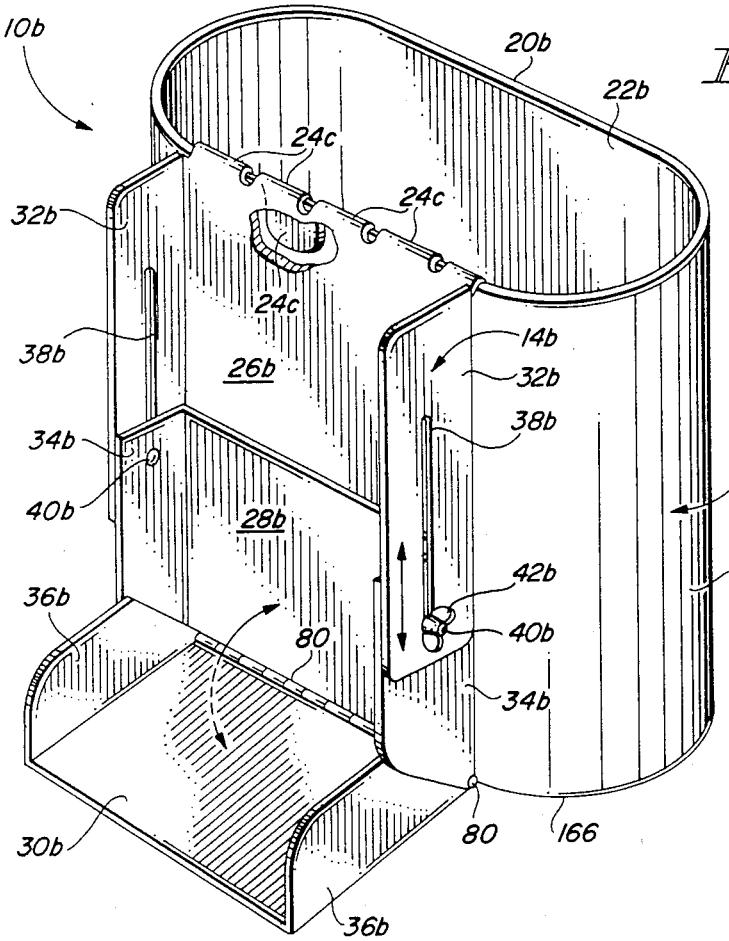
FIG. 3 is a schematic perspective view, partly broken away, of a third preferred embodiment of the improved combination dust chute and wastebasket device of the present invention; and, FIG. 4 is a schematic perspective view, partly broken away, of a fourth preferred embodiment of the improved combination dust chute and wastebasket device of the present invention.

FIG. 1 schematically depicts device 10 which comprises, in combination, a generally vertical wastebasket, bin or can 12 to which is releasably secured a generally vertical dust chute 14. Wastebasket 12 is of conventional construction, size and shape. Thus, it can be of plastic, wood, metal, fiberglass or the like and in FIG. 1 is depicted as upright and oval. It includes a flat closed base 16 connected to vertical sidewalls 18 defining an open upper end 20 communicating with a central storage space 22.

Dust chute 14 is releasably connected to wastebasket 12 by a plurality of horizontally spaced curved, flexible resilient fingers 24 which lap over the rim 26 of upper end 20 from the outside of wastebasket 12 to the inside thereof. Fingers 24 are adapted to releasably fit rim 26 whether rim 26 is curved or straight; that is, whether sidewalls 18 are curved or flat. For this purpose, fingers 24 can be of flexible plastic or rubber or the like. So also can the remainder of chute 14. However, that remainder can also be metal, wood, plastic, rubber, paperboard or other material and is preferably strong and relatively inflexible.

Fingers 24 are connected to the upper end of an upper vertically telescoping generally flat wall 26 forming part of chute 14. Wall 26 is, in turn, connected to a lower vertically telescoping generally flat wall 28 of chute 14. Walls 26 and 28 depend from fingers 24 on the outside of wastebasket 12 and adjacent thereto. The lower end of wall 28 is integrally connected to an inclined ramp 30 which extends downwardly and outwardly therefrom for contact with a floor (not shown) upon which wastebasket 1 may be seated.

Walls 26 and 28 and ramp 30 have pairs of side rims or wings 32, 34 and 36, respectively, which project outwardly from wastebasket 12. Thus, rims 32 and 34 are preferably generally perpendicular to walls 26 and 28, respectively, while rims 36 are also preferably about perpendicular to ramp 30. It will be noted that rims 32 are outside of rims 34 which, in turn, overlap rims 36. Walls 26 and 28 are telescoped together, with wall 28 lying over wall 26. Rims 32 bear vertical slots 38 while threaded bolts 40 are secured to rims 34 and project throughout slots 38. Wing nuts 42 threaded over bolts 40 releasably hold rims 32 and 34 (and thus walls 26 and 28) together. With this arrangement the overall height of chute 14 can be adjusted so that the lower end of ramp 30 can touch the floor for efficient transfer of dust and debris into chute 14.

If chute 14 is made from plastic or other flexible material, chute 14 can be readily deformed to have the top or entire body thereof conform to the shape of can 12. Since ramp 30 is fixedly secured to wall 28, it moves up and down with it. Rims 36 are bolted to rims 34 to maintain ramp 30 at a fixed angle to wall 28.

It will be seen that trash can be swept by a broom directly onto ramp 30 and up chute 14 between the side rims thereof and thus over fingers 24 and into space 22 of wastebasket 12. A broom is selected which is sufficiently wide to about span the space between the chute side rims so that dust and debris does not fall down on ramp 30 from the broom. With this technique, no dust pan is needed. Moreover, chute 14 can remain in place on wastebasket 12 or be detached after wastebasket 12 is filled and can be placed on another wastebasket.

If desired, a so-called splash guard can be provided with chute 14, as shown in FIG. 1 to prevent swirling of dust and debris during their transfer into space 22. Thus, guard 44 is shown which comprises a hood 46 having a closed top 48, back 50 and sides 52, the latter bearing depending legs 54 hingedly connected to the upper ends of rims 32. Hood 46 is open at the bottom thereof to provide access to space 22. In the operative position shown in FIG. 1, hood 46 overlies and is spaced well above rim 20. It can be pivoted between this position and one in which it is swung forward in front of rims 32 and 34 so as to fully expose all of the top of space 22 for easy dumping of trash from space 22. Hood 46 can be fabricated of any suitable self-supporting material.

Accordingly, device 10 is a simple, inexpensive, durable and efficient means for quickly transferring dust and debris from the ground into space 22 without bending over or using a dust pan. Chute 14 efficiently guides the trash to space 22, under the urging of a broom which can be easily used as the sole trash-gathering and trash-moving instrument.

Figure 4:
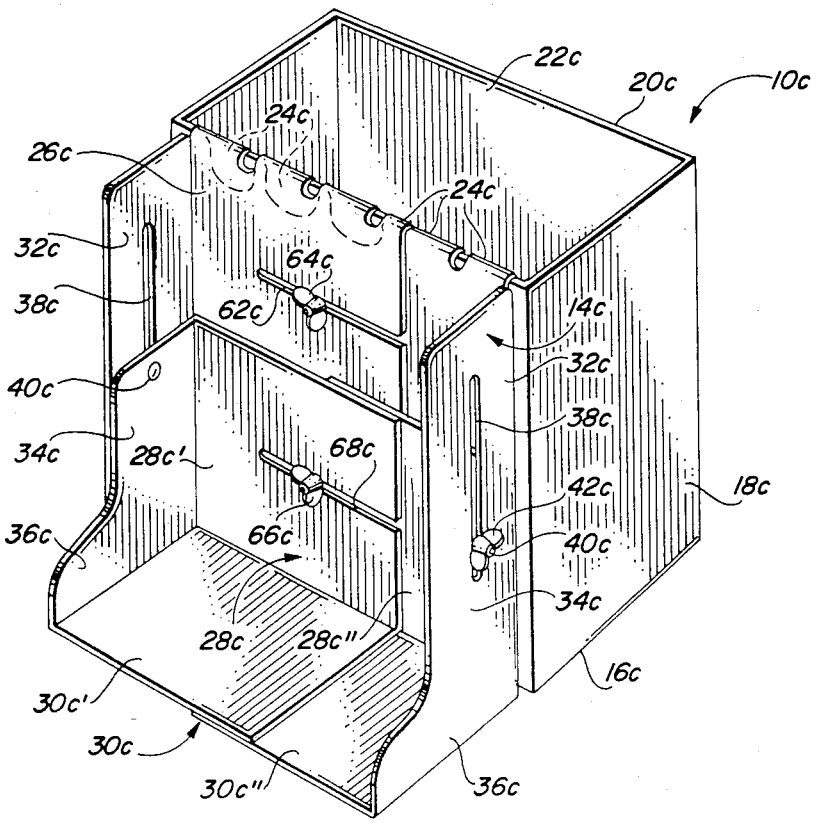

FIGS. 2, 3 and 4

Second, third and fourth preferred embodiments of the device of the present invention are schematically depicted in FIGS. 2, 3 and 4, respectively. Thus, device **10*a* is shown in FIG. 2, device 10*b* is shown in FIG. 3 and device 10*c* is shown in FIG. 4. Components similar to those of FIG. 1 bear the same numerals, but are succeeded by the letter "a" in FIG. 2, the letter "b" in FIG. 3 and the letter "c" in FIG. 4**.

FIG. 2

Device **10*a* is substantially identical to device 10, except that no splash guard 44 is present. Moreover, walls 26*a* and 28*a* and ramp 30*a* are split longitudinally into 2 horizontally telescoping halves 26*a*' and 26*a*'', 28' and 28*a*'' and 30*a* and 30*a*'', respectively. Halves 26*a* and 26*a*'' are releasably secured together by a threaded bolt 60 in half 26*a*'' extending through a horizontal slot 62 in half 26*a*' and secured by a winged nut 64. Similarly, halves 28*a*' and 28*a*'' are secured together by threaded bolt 66 in half 28*a*'' passing thru slot 68 in half 28*a*' and secured by winged nut 70. Half 30*a*'' bears bolt 72 passing through slot 74 in half 30*a*' and secured by winged nut 76. Rims 36*a* are not bolted to rims 34*a*. This arrangement allows the width of the three parts of chute 14*a* to be individually adjusted to fit the width of the broom to be used to push trash up chute 14. Thus, for example, chute 14*a* can gradually widen from bottom to top. Device 10*a* has the other advantages of device 10**.

FIG. 3

Device **10*b* of FIG. 3 is substantially identical in construction and function to device 10 except for the absence of guard 44 and the presence of hinge means 80 interconnecting ramp 30*b* with wall 28*b* to permit the angle of ramp 30*b* to be adjusted as needed. Rims 36*b* are not bolted to rims 34*b***.

FIG. 4

Device **10*c* is substantially identical to device 10*a* in construction and function, except that ramp 30*c* is integral with and carried along by wall 28*c*. Accordingly, it does not have a slot and bolt array, although it is divided into telescoping ramp halves 30*c*' and 30*c*''. Wall halves 26*c* ' and 26*c*'' bear, respectively, slot 62*c* and headed bolt 60*c*, while wall halves 28*c*' and 28*c*'' bear, respectively, slot 68*c* and headed bolt 66*c*. Moreover, wastebasket 12*c*** is rectangular rather than oval in plan view.

Various other modifications, changes, alterations and additions can be made in the improved device of the present invention, the improved dust chute and components and parameters thereof. All such modifications, changes, alterations and additions as are within the scope of the appended claims form part of the present invention.

What is claimed is:

1. An improved dust chute and wastebasket device, said device comprising, in combination:

(a) an upstanding wastebasket having an open upper end and closed bottom and sidewalls defining a central storage space; and (b) an upstanding dust chute releasably connected to said wastebasket at said upper end and extending down the outside of said wastebasket to about the bottom thereof, said chute including:

i. upper and lower vertically telescoping walls, said upper telescoping wall including curved gripping means lapping over and releasably gripping the upper edge of said upper end of said wastebasket and, ii. an inclined ramp connected to and sloped downwardly and outwardly from the lower end of said lower telescoping wall, said telescoping walls and ramp including side rims angled outwardly therefrom to confine dust and debris in said chute during sweeping thereof by a broom from a floor upon which said wastebasket rests to said central storage space.

2. The improved device of claim 1 wherein said wastebasket and chute are generally vertical and wherein said side rims are about perpendicular to said telescoping walls and ramp.

3. The improved device of claim 1 wherein said gripping means are fingers which are resilient and flexible and adapted to grip the upper edge of said upper end of said wastebasket, whether said upper end is flat or curved.

4. The improved device of claim 3 wherein said fingers comprise at least one of plastic and rubber.

5. The improved device of claim 3 wherein said chute comprises at least one of plastic and rubber.

6. The improved device of claim 1 wherein said chute includes a splash guard hingedly connected to the upper end of said upper telescoping wall and movable between a first position overlying and a second position away from said wastebasket upper end, said splash guard comprising a pair of spaced depending legs hingedly connected at their lower ends to opposite sides of said upper telescoping wall and an open bottomed hood connected to the upper end of said legs.

7. The improved device of claim 1 wherein said gripping means are fingers and wherein said inclined ramp is hingedly connected to said lower telescoping wall so that the angle of said ramp can be changed.

8. The improved device of claim 1 wherein said vertically telescoping walls and inclined ramp telescope laterally to adjust the space between said rims in order to accommodate brooms of various widths.

9. An improved dust chute for a wastebasket substantially as set forth in any of the preceding claims 1 through 8.

10. An improved dust chute and wastebasket device, said device comprising, in combination:

(a) an upstanding wastebasket having an open upper end and closed bottom and sidewalls defining a central storage space;

(b) an upstanding dust chute releasable connected to said wastebasket at said upper end and extending downwards along the outside of and adjacent to said wastebasket to about the bottom thereof, said chute including:

i. a base portion having walls extending forwardly therefrom at substantially right angles thereto ii. said base portion having gripping means secured to the top thereof adapted to releasably secure said base portion to said wastebasket, and iii. an inclined ramp portion secured to said base portion at an angle with respect thereto and having walls extending forwardly therefrom at substantially right angle thereto, wherein said chute and walls serve to confirm dust and debris in said chute during sweeping thereof by a broom from a floor upon which said wastebasket rests into said central storage space.

11. The device of claim 10 wherein said dust chute is made of a flexible material which allows at least a part of said chute to be deformed so as to conform to wastebaskets of varying dimensions.

12. The device of claim 11 including means to vary at least one of either the length or width of said chute.

* * * * *